United States Patent [19]

Lonati

[11] Patent Number: 4,856,300

[45] Date of Patent: Aug. 15, 1989

[54] DEVICE FOR SELECTING NEEDLES IN CIRCULAR KNITTING MACHINES FOR HOSIERY AND THE LIKE

[75] Inventor: Francesco Lonati, Brescia, Italy

[73] Assignee: Lonati S.p.A., Brescia BS, Italy

[21] Appl. No.: 153,759

[22] Filed: Feb. 8, 1988

[30] Foreign Application Priority Data

Feb. 16, 1987 [IT] Italy ..... 19395 A/87

[51] Int. Cl.[4] ..... D04B 15/78

[52] U.S. Cl. ..... 66/221; 66/222

[58] Field of Search ..... 66/75.2, 219, 221, 222

[56] References Cited

U.S. PATENT DOCUMENTS 4,214,460 7/1980 Shima ..... 66/75.2

FOREIGN PATENT DOCUMENTS 51-40460 4/1976 Japan ..... 66/75.2

730 3/1981 PCT Int'l Appl. ..... 66/75.2

*Primary Examiner*—Wm. Carter Reynolds

*Attorney, Agent, or Firm*—Guido Modiano; Albert Josif

[57] ABSTRACT

The device is provided with a plurality of selection levers pivotally connected to a support structure and having an end adjacent to the needle cylinder in the zone of the selectors. Actuators oscillate the selection levers in a plane parallel to the extension of the selectors, from an operative position, whereat the end is located at an intermediate level between the selector butts to avoid interference therewith, to an operative position whereat the end is located at the level of the selector butts to interfere therewith. Each selection lever has a first portion and a second portion which are spaced apart, extend parallel to the axis of their pin, and are connected together by cross-members defining a seat for the pin. The first portion has, at its intermediate part, a plate which extends in the direction of the selector butts, and which constitutes the end engageable therewith.

20 Claims, 2 Drawing Sheets

DEVICE FOR SELECTING NEEDLES IN CIRCULAR KNITTING MACHINES FOR HOSIERY AND THE LIKE

BACKGROUND OF THE INVENTION

The present invention relates to a device for selecting needles in circular knitting machines for hosiery and the like.

Numerous devices are known for the selection of needles in knitting machines and the like. In particular, a device is known which is described in U.S. Pat. No. 4,790,154, granted on Dec. 13, 1988, to the same applicant.

That device comprises a plurality of superimposed selection levers which are individually pivotally connected at an intermediate portion thereof to a support structure and have an end facing the needle cylinder in the zone of the selectors or sub-needles.

The selection levers are individually oscillatable in a plane extending substantially parallel to the extension of the selectors, which pass in front of the selection levers, from an inoperative position, whereat the cited end is located at an intermediate level between the selector butts to avoid interference therewith, to an operative position whereat the cited end is located at the level of the butts to interfere therewith, so as to actuate or not determined selectors which in turn act or do not act on the overlying needles.

Oscillation of the selection levers is effected by actuation levers, which are oscillable in a plane extending substantially parallel to the oscillation plane of the selection levers and which have an end which acts on the opposite part of the selection lever with respect to the selectors.

On each actuation lever act, in an opposed manner, two electromagnets, selectively activatable by a control member which directs the various knitwork workings of the machine.

In order to reduce the overall bulk of the device, even when using a large number of electromagnets, the opposite end of the selection levers is configured as a flat blade, and the end of the actuating lever which engages therewith is bifurcated so as to embrace both sides of the flat blade.

In this way it is possible to arrange the assemblies, constituted by a pair of electromagnets and the relative actuating lever, in a superimposed and laterally offset manner.

That type of device, while permitting a large number of selections, reducing bulk, and increasing actuation speed, has been found to be susceptible, during the course of experimentation, to further modifications directed mainly to the achievement of an even higher actuation speed, so as to increase the potential productivity of the machine and the types of knitwork working which can be performed thereby.

SUMMARY OF THE INVENTION

The aim of the present invention is indeed that of providing a device for the selection of the needles which is extremely reliable and has a long working life at increased operating speeds with respect to known types.

Within this aim, an object of the present invention is to provide a device having a reduced bulk so as to not present an obstacle to the installation of other devices in the zone of the selectors of a knitting machine or the like.

Another object of the invention is to provide a device which is of reduced cost and high reproducibility in manufacture.

This aim and these and other objects which will become apparent hereinafter are achieved by a device for the selecting needles in circular knitting machines for hosiery and the like, comprising a plurality of superimposed selection levers, individually pivotally connected at an intermediate portion thereof to a support structure, said selection levers having an end adjacent to the needle cylinder in the zone of the selectors and being individually oscillatable in a plane substantially parallel to the extension of the selectors, which pass in front of said selection levers, from an inoperative position, whereat said end is located at an intermediate level between the selector butts to avoid interference therewith, to an operative position whereat said end is located at the level of the selector butts to interfere therewith, there also being provided actuation means adapted to act on the end of said selection levers located remote from the selectors for moving the relative selection lever from said inoperative position to said operative position and vice versa, characterized in that each of said selection levers is substantially constituted by a first portion and a second portion which are spaced apart and extend substantially parallel to the axis of their pin, said portions being connected together, at least proximate to their longitudinal end, by cross-members defining a seat for said pin, said first portion having at an intermediate portion of its longitudinal extension a plate extending in the direction of the selector butts and defining said extremity engageable with said selector butts.

BRIEF DESCRIPTION OF THE DRAWINGS

Further features and advantages of the invention will become apparent from the description of a preferred, but not exclusive embodiment, of the device according to the invention, illustrated in the accompanying illustrative, non-limitative drawings wherein.

DESCRIPTION OF THE PREFERRED EMBODIMENTS

Figure 1:
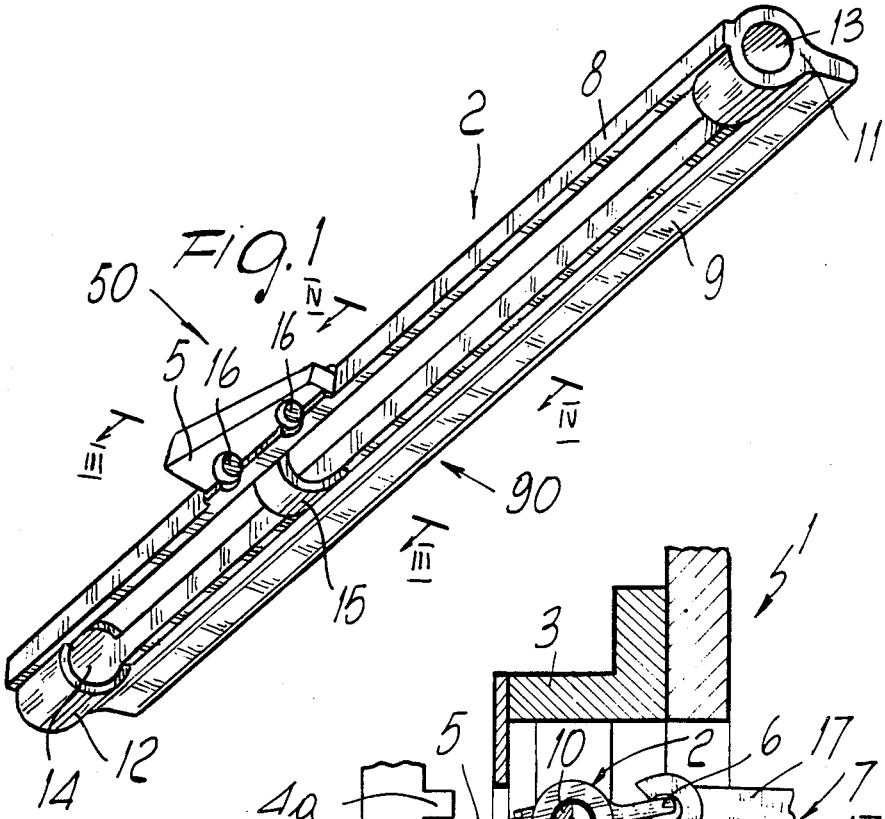
FIG. 1 is a perspective view of a selection lever according to the invention.
Figure 2:
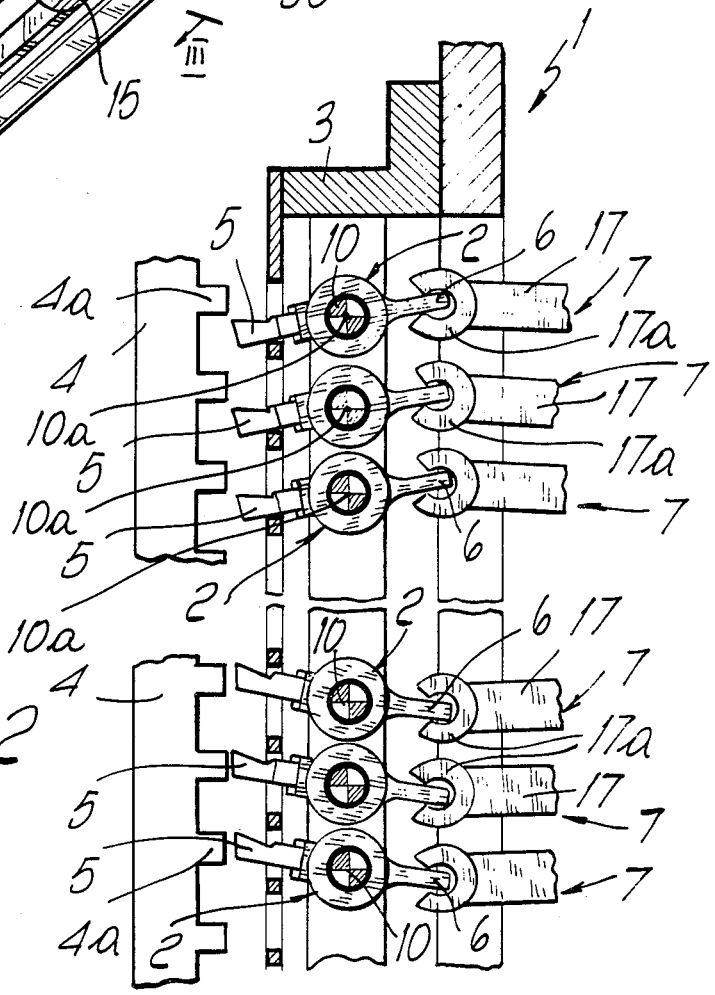
FIG. 2 is a partly cut-away schematic side elevation view of part of the device according to the invention.
Figure 4:
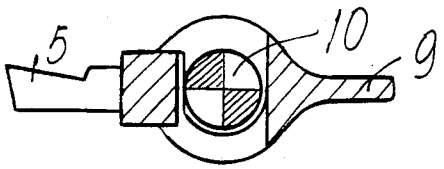
FIG. 4 is an enlarged cross-section view of the selection lever illustrated in FIG. 1, as taken along the axis IV—IV.
Figure 3:
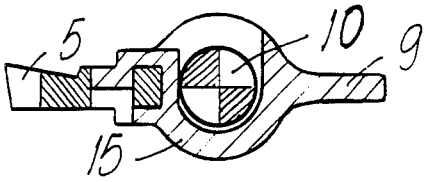
FIG. 3 is an enlarged cross-section view of the selection lever illustrated in FIG. 1, as taken along the axis III—III.
Figure 5:
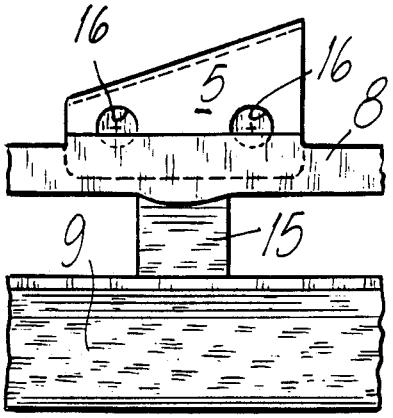
FIG. 5 is an enlarged top plan view of a portion of the lever according to the invention.
Figure 6:
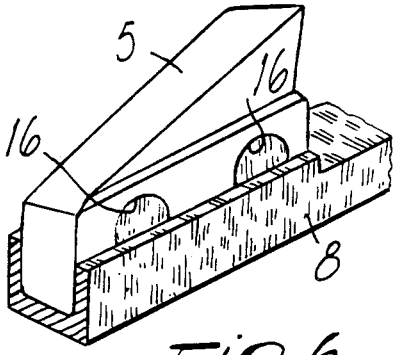
FIG. 6 is a cut-away perspective view showing the connection between the plate and the first portion of a selection lever according to the invention.
Figure 7:
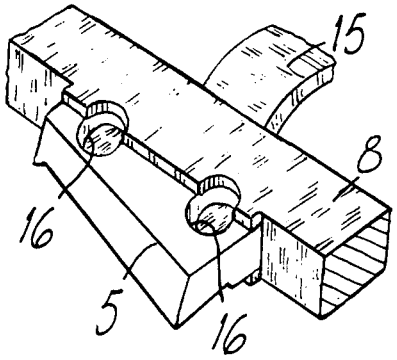
FIG. 7 is a bottom perspective view of the intermediate zone of the first portion of a selection lever according to the invention.
Figure 8:
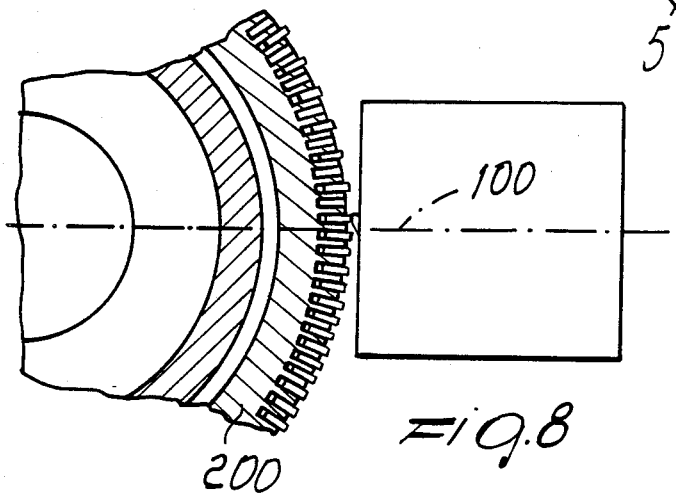
FIG. 8 is a top plan view of the device according to the invention.

With reference to the cited drawing figures, the selection device according to the invention, generally indicated by the reference numeral 1 and schematically illustrated in FIG. 2, is of the type comprising a plurality of superimposed selection levers 2 pivotally connected at an intermediate portion thereof to a support structure 3 which is located proximate to the needle cylinder 200 of a circular knitting machine, for hosiery or the like, in the zone of the selectors 4 or sub-needles. The selection levers 2 each have an end 5 facing the needle cylinder and are individually oscillable in a plane 100 parallel to the extension of the selectors 4, which during operation of the machine pass in front of the selection levers. Upon oscillation of each selection lever, the end 5 can be moved from an inoperative position, whereat the end is located at an intermediate level between the butts 4a of the selectors 4 to avoid interference therewith, to an operative position, whereat the end is located at the level of the selector butts to interfere therewith.

Actuation means 7 act on the other end 6 of the selection lever which is located remote from the selectors 4, to cause the cited oscillation of the selection lever from the operative position to the inoperative position and vice versa.

According to the invention, each selection lever is substantially constituted by a first portion 8, and a second portion 9 spaced therefrom, which extend substantially parallel to the axis 10a of the relative pin 10 and are connected proximate to their longitudinal ends by crossmembers, 11 and 12 respectively, each having defined therein a seat 13 and 14 for the pin 10. The first portion 8 has, at an intermediate zone of its longitudinal extension defining a first portion intermediate zone 50, a plate which extends in the direction of the selector butts and defines the end 5 engageable with said butts.

Advantageously, in order to increase the strength of the levers in the zone whereat they are subject to the greatest stresses, i.e., the zone bearing the plate 5, there is provided a further cross-member 15 which connects the first portion intermediate zone 50 defined by the first portion 8 and a second portion intermediate zone 90 defined by the second portion 9.

Advantageously, the first portion 8, the second portion 9, and the cross-members 11, 12, and 15, can be made as a single piece in moulded synthetic material of low specific weight.

From experimental tests, it has been found that said synthetic material can advantageously comprise carbon fibre, or fibre-glass reinforced nylon, or nylon reinforced with a molybdenum disulfied compound commercially known by the name "Molikote", having optimum self-lubricating qualities, particularly exploitable for the seats 13 and 14 which couple with the pin 10.

The plate 5, which is the part of the lever subject to most wear, can be made of high strength steel and partially embedded in synthetic material which constitutes the first portion 8 during the moulding step. In order to firmly anchor the plate 5 to the first portion 8, on the plate 5 can be provided recesses or through holes defining undercuts 16 which become partially or totally filled with synthetic material during the moulding step.

Advantageously, in order to obtain optimum balancing of each selection lever with respect to the axis of the relative pin 10, the distances from the end of the plate 5 engageable with the butts of the selectors, to the axis of the pin 10, and from the end of the second portion 9 engageable with the actuation means to the axis of the pin 10, are substantially equal.

The actuation means 7 may comprise electromagnetic actuators, for example of the type described in the above-cited U.S. Pat. No. 4,790,154 with two electromagnets which act in opposition on an oscillating lever 17 having a bifurcated end 17*a* engaging with the second portion 9 of each selection lever. Advantageously, the second portion 9 of the selection lever is manufactured with a plate-like configuration, or more precisely in the form of a flat blade throughout its length, so as to permit the installation of a large number of electromagnetic actuators superimposed and laterally offset from each other in an extremely small space.

The working of the selection device according to the invention is evident, and in particular, it is apparent that the control member which directs the various knitwork workings of the machine, actuating the electromagnetic actuators, causes the oscillation of the selection levers from the operative position to the inoperative position and vice versa.

It has been shown in practice that the device according to the invention fully achieves the proposed objects in that, by virtue of the extremely light weight of the selection levers manufactured with the particular conformation and from materials of low specific weight utilizable without penalizing the strength of the selection lever, it is possible to achieve higher operating speeds than is possible with devices of known type.

Another advantage resides in the great reduction of wear which occurs between the selection lever and the relative pin.

The above-described device is susceptible to numerous modifications and adaptations, all falling within the purview of the inventive concept; furthermore, all of the details may be substituted with technically equivalent elements.

In practice, the materials used may be substituted by other materials having characteristics which are equivalent to those cited.

I claim:

1. A device for the selecting needles in circular knitting machines having a needle cylinder and a support structure, comprising a plurality of selectors, each selector having at least one selector butt, a plurality of superimposed selection levers each having an intermediate portion, each intermediate portion of each selection lever being pivotally connected to said support structure by a pin, each said pin having a pin axis, said selection levers each having at least one end located adjacent to said needle cylinder proximate to said selectors and at least one other end located remote from said selectors, said selection levers each being oscillatable in a plane substantially parallel to said selectors, said selectors being arranged to pass in front of said selection levers during operation of a knitting machine, from an inoperative position, whereat said one end is located between said selector butts to avoid interference therewith, to an operative position whereat said one end is located on a level with said selector butts to interfere therewith, said device further comprising actuation means adapted to act on said other end of each of said selection levers for moving the relative selection lever from said inoperative position to said operative position and vice versa, wherein each of said selection levers comprises:

at least one first portion having a longitudinal extension and defining first portion ends and a first portion intermediate zone;

at least one second portion spaced from said first portion and extending substantially parallel to said pin axis, said second portion defining second portion ends and a second portion intermediate zone;

a space defined between said first portion and said second portion;

a plurality of cross-members extending across said space and interconnecting said first portion and said second portion at least proximate to said first portion ends and said second portion ends;

at least one seat defined by said plurality of cross-members, said seat accommodating said pin, and;

at least one plate rigidly associated with said intermediate zone of said first portion, said plate extending towards said selector butts and defining said at least one end of each of said selection levers located adjacent to said needle cylinder proximate to said selectors.

2. Device according to claim 1, wherein said plurality of cross-members comprise at least one intermediate cross-member, said intermediate cross-member extending across said space and interconnecting said first portion intermediate zone to said second portion intermediate zone.

3. Device according to claim 1, wherein said first portion, said second portion, and said cross-members are made of moulded synthetic material.

4. Device according to claim 3, wherein said synthetic material comprises carbon fibre.

5. Device according to claim 3, wherein said synthetic material comprises fibre-glass reinforced nylon.

6. Device according to claim 3, wherein said synthetic material comprises nylon reinforced with "Molikote".

7. Device according to claim 1, wherein said plate is made of steel and is partially embedded in said first portion.

8. Device according to claim 1, wherein a first distance is defined between said at least one end of each of said selection levers located adjacent to said needle cylinder proximate to said selectors and said pin axis, and wherein a second distance is defined between said other end of each of said selection levers and said pin axis, said first distance being substantially equal to said second distance.

9. Device according to claim 1, wherein said second portion of each of said selection levers has a flat conformation bilaterally coupleable with at least one electromagnetically controlled actuating lever.

10. Device according to claim 1, wherein said plate has recesses, said recesses defining undercuts, said undercuts constituting means for anchoring said plate to said first portion of said selection lever.

11. A device for the selecting needles in circular knitting machines having a needle cylinder and a support structure, comprising a plurality of selectors, each selector having at least one selector butt, a plurality of superimposed selection levers each having an intermediate portion, each intermediate portion of each selection lever being pivotally connected to said support structure by a pin, each said pin having a pin axis, said selection levers each having at least one end located adjacent to said needle cylinder proximate to said selectors and at least one other end located remote from said selectors, said selection levers each being oscillatable in a plane substantially parallel to said selectors, said selectors being arranged to pass in front of said selection levers during operation of a knitting machine, from an inoperative position, whereat said one end is located between said selector butts to avoid interference therewith, to an operative position whereat said one end is located on a level with said selector butts to interfere therewith, said device further comprising actuation means adapted to act on said other end of each of said selection levers for moving the relative selection lever from said inoperative position to said operative position and vice versa, wherein each of said selection levers comprises:

at least one first portion having a longitudinal extension and defining at least one first portion end, at least one other first portion end, and a first portion intermediate zone;

at least one second portion spaced from said first portion and extending substantially parallel to said pin axis, said second portion defining at least one second portion end, at least one other second portion end, and a second portion intermediate zone;

a space defined between said first portion and said second portion;

at least one first cross-member extending across said space and interconnecting said one first portion end to said one second portion end;

at least one second cross-member extending across said space and interconnecting said other first portion end to said other second portion end;

at least one seat defined by said first cross-member and said second cross member, said seat accommodating said pin, and;

at least one plate rigidly associated with said intermediate zone of said first portion, said plate extending towards said selector butts and defining said at least one end of each of said selection levers located adjacent to said needle cylinder proximate to said selectors.

12. Device according to claim 11, further comprising at least one intermediate cross-member, said intermediate cross-member extending across said space and interconnecting said first portion intermediate zone to said second portion intermediate zone.

13. Device according to claim 11, wherein at least said first portion, said second portion, said first cross-member and said second cross-member are made of moulded synthetic material.

14. Device according to claim 13, wherein said synthetic material comprises carbon fibre.

15. Device according to claim 13, wherein said synthetic material comprises fibre-glass reinforced nylon.

16. Device according to claim 13, wherein said synthetic material comprises nylon reinforced with "Molikote".

17. Device according to claim 11, wherein said plate is made of steel and is partially embedded in said first portion.

18. Device according to claim 11, wherein a first distance is defined between said at least one end of each of said selection levers located adjacent to said needle cylinder proximate to said selectors and said pin axis, and wherein a second distance is defined between said other end of each of said selection levers and said pin axis, said first distance being substantially equal to said second distance.

19. Device according to claim 11, wherein said second portion of each of said selection levers has a flat conformation bilaterally coupleable with at least one electromagnetically controlled actuating lever.

20. Device according to claim 11, wherein said plate has recesses, said recesses defining undercuts, said undercuts constituting means for anchoring said plate to said first portion of said selection lever.

* * * * *